US005313971A

United States Patent [19]

Upshaw

[11] Patent Number: 5,313,971

[45] Date of Patent: May 24, 1994

[54] CRUTCH SLING LEG SUPPORT APPARATUS AND METHOD

[76] Inventor: Jim L. Upshaw, 1715 Channel Rd., Austin, Tex. 78746

[21] Appl. No.: 945,005

[22] Filed: Sep. 15, 1992

[51] Int. Cl.[5] ..... A61H 3/02

[52] U.S. Cl. ..... 135/68; 135/65; 135/69

[58] Field of Search ..... 135/68, 69, 65; 248/155.1

[56] References Cited

U.S. PATENT DOCUMENTS

| | | | |
|---|---|---|---|
| D. 114,912 | 5/1939 | Upton . | |
| D. 180,867 | 10/1954 | deGignac . | |
| D. 228,822 | 10/1973 | Vesey . | |
| D. 255,288 | 6/1980 | Thomas . | |
| 906,845 | 12/1908 | Adair | 135/67 |
| 979,959 | 12/1910 | Johnson . | |
| 2,208,195 | 7/1940 | Paul . | |
| 2,755,096 | 7/1956 | Fishalow . | |
| 2,855,024 | 10/1958 | Robb | 135/67 |
| 3,443,569 | 5/1969 | Ernst . | |
| 4,793,370 | 12/1988 | Perez et al. | 135/68 |
| 4,850,383 | 7/1989 | McBride | 135/68 |
| 4,884,587 | 12/1989 | Mungons . | |
| 4,941,498 | 7/1990 | Escallier . | |
| 5,165,436 | 11/1992 | Hall, Sr. et al. | 135/68 |

FOREIGN PATENT DOCUMENTS

| | | | |
|---|---|---|---|
| 0118469 | 9/1918 | United Kingdom | 135/68 |
| 0135275 | 11/1919 | United Kingdom | 135/49 |
| 0486902 | 5/1918 | France | 135/68 |

*Primary Examiner*—Carl D. Friedman
*Assistant Examiner*—Wynn E. Wood
*Attorney, Agent, or Firm*—Arnold, White & Durkee

[57] ABSTRACT

Orthopedic sling support for a leg (or foot) is provided that utilizes a pair of conventional crutches and an adjustable crutch sling assembly. The leg support is preferably comprised of a top cover to which a leg sling is attached by flexible straps, all of which is preferably constructed of light-weight, durable, and washable fabric. The top cover is intended to fit snugly over the shoulder rests of the pair of crutches, and is shaped in such a way as to allow creation of an A-frame structure from which the sling is suspended by connecting straps. The connecting straps are preferably adjustable to allow positioning the leg sling at a desired height for supporting the user's leg.

18 Claims, 3 Drawing Sheets

CRUTCH SLING LEG SUPPORT APPARATUS AND METHOD

BACKGROUND OF THE INVENTION

1. Field of the Invention

This invention relates to an orthopedic sling support, and more particularly to a flexible sling adapted for use with a pair of conventional crutches to enable the user in a sitting or reclining position to support and elevate a leg.

2. Description of the Related Art

In treating a leg injury or surgery, many doctors recommend elevation of the injured leg to facilitate the healing process. Elevation of the limb improves circulation, thus promoting healing and often lessening patient discomfort and pain by reducing the swelling that may accompany a variety of leg injuries. Many people attempt to elevate an injured leg by propping the leg on available furniture or other stationary objects. However, supporting objects such as furniture may not always be available to patients. Thus a need exists for providing a portable means for elevating the injured foot or leg of such a patient.

Specialized devices designed for limb elevation have been proposed, which partially address the needs of a mobility-impaired user for portable elevated support of an injured limb. For example, a combination walking cane/foot rest has been proposed which, in a first position, functions as a conventional cane and, in a second position, functions as a leg rest. Such a device is not convenient for many patients, however, because it is not adaptable for use with a pair of ordinary crutches, which are commonly prescribed for leg injuries. Also known in the art are various attachments to ordinary crutches that may, for example, provide assistance in supporting the weight of a cast on a foot or leg while the user is walking or standing, or be used as a means to secure smaller sized articles to the crutch, thereby allowing the user's hand to remain free to grip the crutches or other objects. Generally, no provision is made in these devices, however, for elevation of a leg of a patient while sitting, independent of furniture or other stationary objects.

In summary, there appears to be no teaching or suggestion in the art of a portable device to support and elevate a foot or leg above the height of a user's hips, which may be desired for some injuries, or by means of a simple, adjustable modification to an ordinary pair of crutches, with which most patients with an injured leg will already be equipped.

SUMMARY OF THE INVENTION

The problems outlined above are addressed by the present invention, which comprises a novel sling assembly attachment for a pair of ordinary crutches. The sling assembly of the present invention is flexible enough to allow for varying degrees of elevation and light enough to allow for convenient portability.

In a general aspect, the current invention provides a simple and portable means to support and elevate a leg or foot using a pair of typical crutches to serve as the structure from which a leg sling may be suspended. Elevated support is provided by the leg sling, which is attached to a bag, hood or other suitable cover that is adapted to slip over the top of the crutches. The cover is shaped such as to hold the horizontal support members, or shoulder rests, of the crutches tightly together, and is flared along its length to allow the bottom of the crutches to be separated. This results in an A-frame type structure with the leg sling suspended between the vertical support members of the two crutches by means of connecting straps. So that varying degrees of leg elevation are available, the connecting straps are preferably adjustable.

Once the crutch sling has been assembled, the patient, in a sitting position, inserts the injured leg or foot into the sling and allows the weight of the leg to be supported by the sling through the crutch structure. The patient's leg serves as an indirect third member of the overall structure, resulting in tripod-like stability.

An important feature of the current invention is its portability. When ambulating is required, the patient need only remove one crutch from the sling assembly cover bag and use the crutches in a normal manner. The sling assembly material is preferably constructed of light weight and flexible material so that it may be left attached to the remaining crutch without interfering with normal crutch operation.

The advantages of the present invention will be further appreciated from the drawings and from the detailed description provided below.

DESCRIPTION OF THE PREFERRED EMBODIMENT

Figure 1:
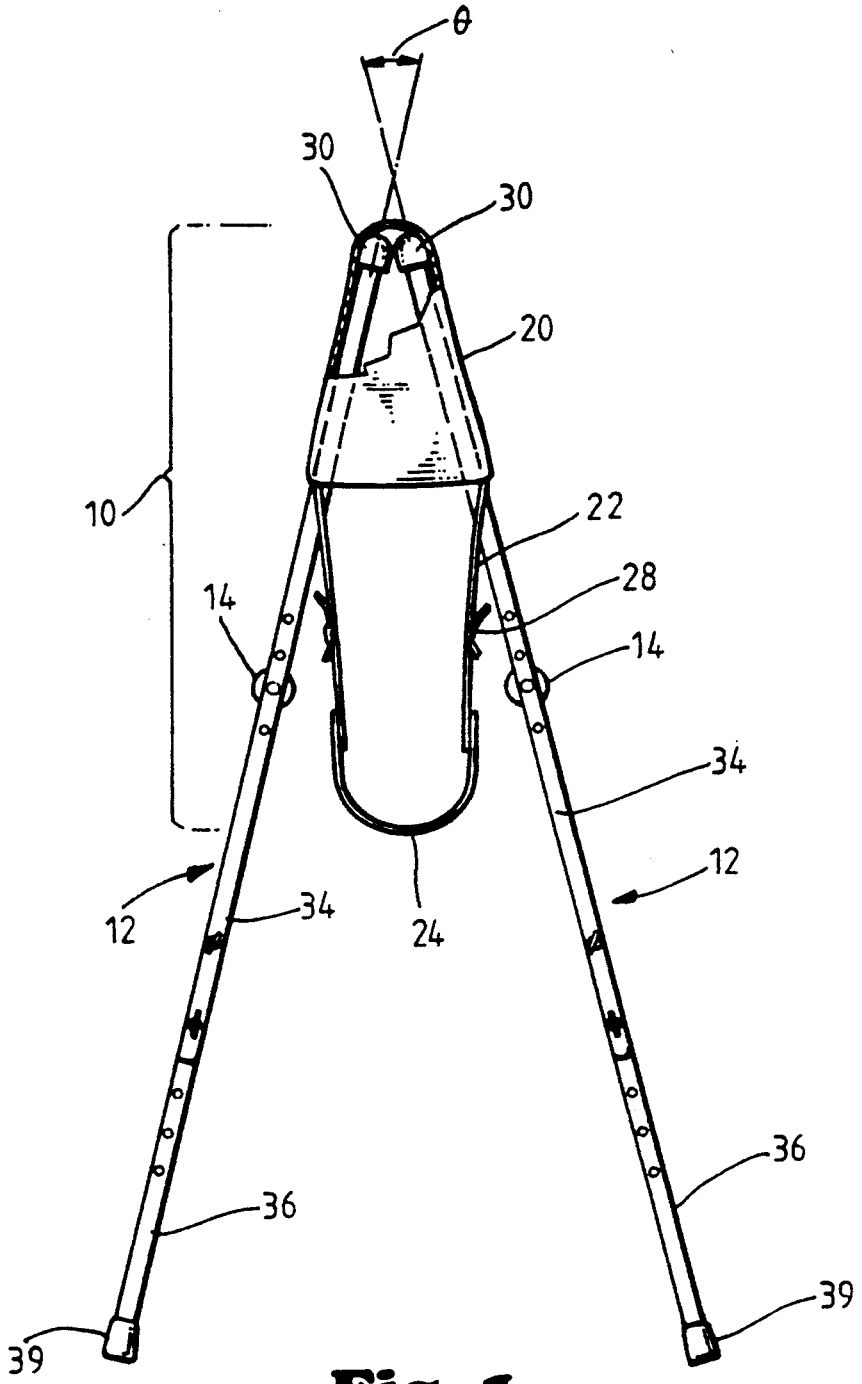
FIG. 1 is a front view of a pair of crutches inserted into a crutch sling assembly in accordance with this invention.
Figure 3:
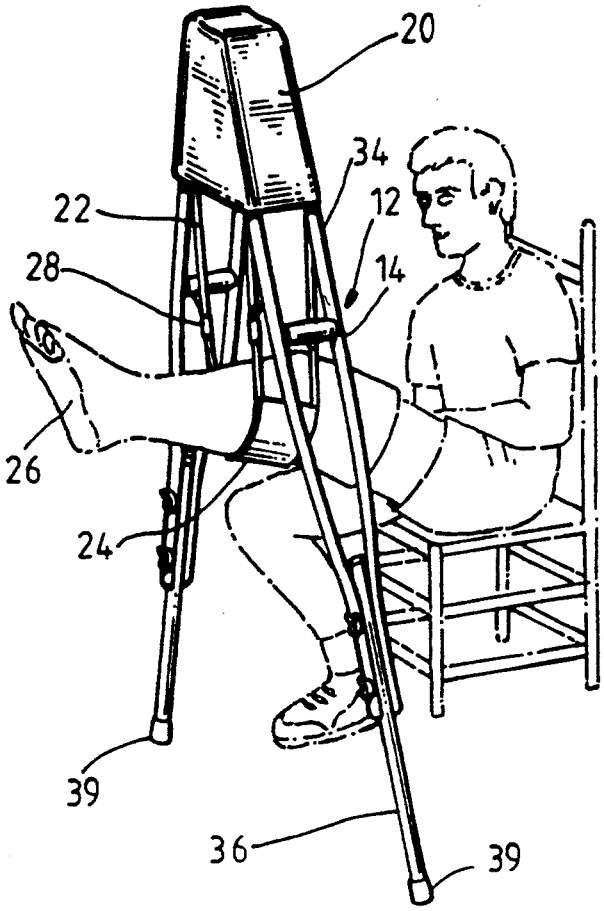
FIG. 3 is a perspective view of the crutch sling assembly and crutches being used as an elevated support for a patient's leg.

Referring to FIGS. 1 and 3, there is shown a crutch sling assembly 10 attached to a pair of crutches 12. Sling assembly 10 is comprised of top cover 20, or framing means, from which sling 24 is suspended.

Top cover 20 is preferably made from a sturdy, flexible fabric sewed into a flared bag shape such that the closed end is smaller than the opposite open end, and is sized to fit closely about the crutches' horizontal or shoulder support members 30 such that these support members are not prone to slip relative to each other. Ordinary crutches typically have a foam-like material covering horizontal support members 30, further reducing the possibility that the horizontal support members will slip from within top cover 20 during use of the crutch sling.

The flared shape of top cover 20 allows vertical support members 36 of crutches 12 to be spaced apart, resulting in angle $\Theta$ as shown in FIG. 1. Other suitable framing means will be apparent to those skilled in the art. For optimal stability, it has been found that the maximum desired angle $\Theta$ is approximately 35°, although the structure may function with greater degrees of crutch separation. In this separated position, crutches 12 form an A-frame type structure, shown in FIGS. 1 and 3. The vertical load carrying capacity of the structure is dependent on such things as the strength of the materials from which the crutches are made, the structure's ability to resist crutch over-separation, and the material strength of crutch sling assembly 10. For a typical pair of crutches 12, the prevention of crutch over-separation may be achieved in part by placing rubberized caps 39 on the tips of crutches 12, which reduce the tendency of vertical support members 36 to slip apart from each other under load stress. Slippage is additionally reduced by the structure of top cover 20, which preferably fits snugly during use over side rails 34 to allow a maximum angle Θ between vertical support members 36 such that structural stability is maintained.

Sling 24 is preferably attached to top cover 20 by a plurality of straps 22. Straps 22 are preferably adjustable in length, so that the degree of elevation of the patient's leg is variable. Such adjustment may be made, for example, by operating buckles 28 or other types of adjustment devices within straps 22. Straps 22 may be attached to top cover 20 by a variety of means, including sewed stitches, pop rivets, hook and loop fasteners, etc. Sling 24 is preferably made from a sturdy, flexible material, and may be sewed or shaped into a simple flat square or rectangular piece, as shown in FIGS. 1 and 3.

Although the crutch sling apparatus depicted in FIGS. 1–4 contemplates top cover bag 20 for fulfilling the triple functions of positioning horizontal support members 30 for nonslippage, preventing crutch bottom separation by acting as a connection member between crutch side rails 34, and providing sites to which sling straps 22 may be attached to the structure, it is anticipated that separate devices of other known materials may be employed to accomplish these functions.

Figure 2A:
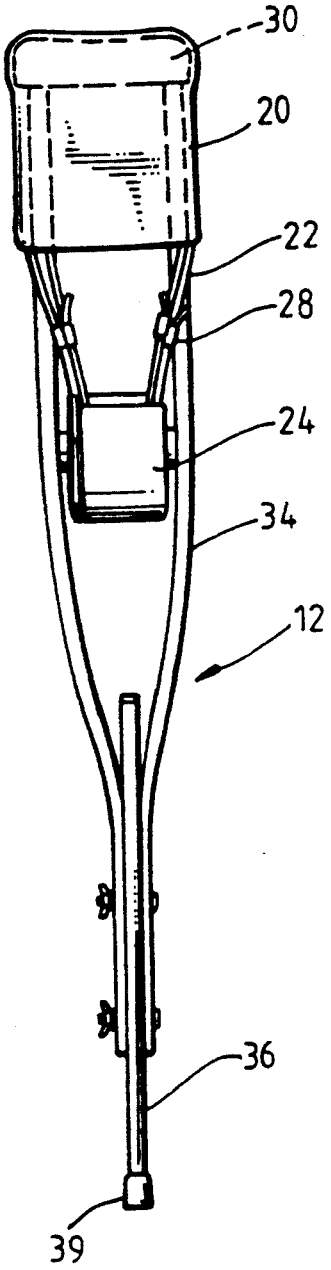
FIG. 2A is a side view of a single crutch inserted into the crutch sling assembly.
Figure 2B:
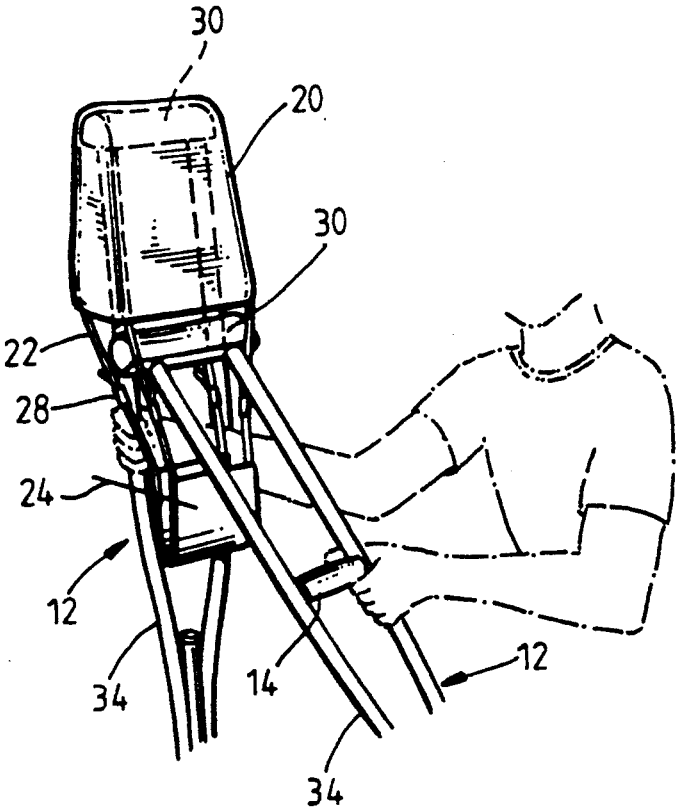
FIG. 2B is a perspective view of the crutch sling assembly attached to one crutch with the other crutch being inserted/withdrawn from the crutch sling assembly.
Figure 4:
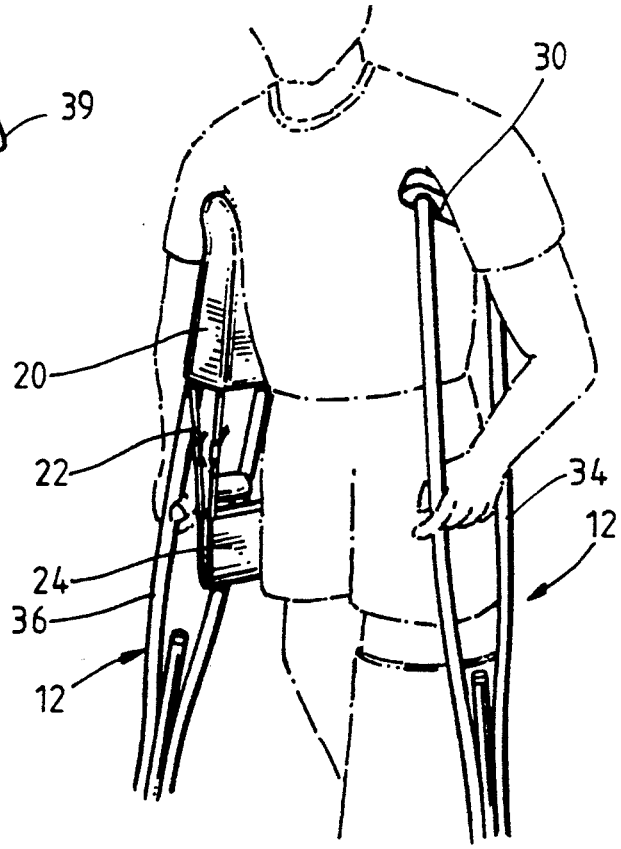
FIG. 4 is a perspective view of a patient ambulating using crutches with the crutch sling assembly attached to only one of the crutches.

Assembly of the crutch sling apparatus is depicted in FIGS. 2A and 2B. Top cover 20 is placed over the vertical support member 36 of one of the crutches 12 as shown in FIG. 2A. When leg support is desired, the second crutch is inserted into top cover 20 as shown in FIG. 2B. Because top cover 20 is preferably constructed from flexible, light-weight material, it is highly portable and does not interfere with normal operation of crutches 12 when ambulation is desired. In that situation, a single crutch 12 is removed from top cover 20, as shown in FIG. 2B. The pair of crutches may then be used in an ordinary manner with crutch sling assembly 10 still attached to one of the pair of crutches 12, as shown in FIG. 4. Because the material of sling assembly 10 may become soiled through such use, the sling assembly is preferably constructed of washable fabric.

With the preferred material for sling assembly 10 being a light-weight fabric, the overall assembly contemplated is capable of being folded into a small package. It is anticipated that one or more pockets may be attached to top cover 20 that would permit sling assembly 10 to be folded and packed away into what would be a pocket-type pouch. Additionally, or in the alternative, the pocket(s) could be used for carrying small articles, such as grooming items, change, keys, etc.

Because the preferred material for leg sling 24 is flexible fabric, sling 24 is permitted to conform under the weight of the user's leg 26 to the shape of the leg, as shown in FIG. 3, thereby offering many support points for more uniformly distributing the weight of the leg. Such uniform weight distribution reduces the often uncomfortable pressure points associated with supporting a leg on a rigid object such as a piece of furniture.

The A-frame structure created by crutch sling assembly 10 in combination with crutches 12 is very nonrestrictive to the user. Though the user's leg 26 may normally engage sling assembly 10 in a manner perpendicular to the A-frame structure, the adjustability of straps 22 allows the user to change the degree of elevation of the leg 26 as desired. Additionally, a person whose leg is being supported by crutch sling assembly 10, as shown in FIG. 3, may extend or retract the leg 26 to some degree without having to make adjustments to the crutch sling support because sling straps 22 are preferably flexible enough to allow sling 24 to rock back and forth or side to side to a limited degree. Additionally, the A-frame structure itself may pivot and rotate about the floor contact points in the plane that is in line with the user's leg 26. The ability of the entire crutch sling apparatus to accommodate minor body movements of the user adds to the user's comfort, and possibly increases, relative to other apparatus for leg elevation,the variety of tasks the user may accomplish even though restricted to a sitting position.

From the disclosure and descriptions of the invention shown or described herein, it can be appreciated that an effective, portable leg-elevating support structure is possible by combining the crutch sling assembly of the present invention with ordinary crutches. Although the present invention has been disclosed in connection with specific embodiments, it will be apparent to those skilled in the art that variations from the illustrated embodiments may be undertaken without departing from the spirit and scope of the invention. It is intended that the following claims cover all equivalent modifications and variations as fall within the scope of the invention.

What is claimed is:

1. A leg support for use in combination with a pair of crutches, each crutch having a horizontal support member secured to one end of a vertical support member, said vertical support member extending from said horizontal support member and terminating at a distal end, said leg support comprising:

a sling support so dimensioned to hold the horizontal support members of each of the crutches tightly together such that the distal ends of the vertical support members may be spaced apart, resulting in an A-frame structure; and a sling suspended from said sling support to a position below said horizontal support members and configured to serve as a leg support.

2. The leg support of claim 1, wherein said sling support comprises a flared bag of flexible material having a closed end being narrower than an opposite open end, said bag being capable of tightly gripping the horizontal support members of said pair of crutches.

3. The leg support of claim 1, wherein said sling is sufficiently flexible to conform to a user's leg.

4. The leg support of claim 3, wherein said sling comprises cloth-like material.

5. The leg support of claim 1, further comprising a plurality of straps attached to the sling support and adapted to suspend the sling from the sling support.

6. The leg support of claim 5, wherein said straps are independently adjustable so that the suspension distance of the sling from the sling support is variable.

7. A crutch structure, comprising:

a pair of crutches, each crutch having a shoulder support at an upper end and a tip at a lower end;

a hood configured at a closed, upper end to enclose the shoulder support of the crutches in a snug relationship, and flared at an open, lower end to enable the tips of the crutches to be spaced apart sufficiently to define an A-frame structure; and a sling attached to and suspended from the hood, and configured to support the leg of a user with the user in a seated or reclining position.

8. The crutch structure of claim 7, further comprising a plurality of adjustable length straps attached to the hood and adapted to suspend the sling from the hood.

9. A method of elevating a leg, comprising:

providing a pair of crutches each having a shoulder rest mounted on a vertical support member, said vertical support member terminating in a tip;

providing a flared bag adapted to secure the shoulder rests of said pair of crutches together in a manner that allows the tips of the vertical support members to be spaced apart relative to the shoulder rests;

placing said flared bag over said shoulder rests of said crutches;

separating the crutch tips such that the resulting structure is an A-frame;

affixing a leg support means to said flared bag so that said leg support means extends to a position below said shoulder rests; and placing the leg desired to be elevated in the leg support means.

10. The method of claim 9, wherein said affixing step further comprises providing a plurality of adjustable straps so that the distance between said leg support means and said shoulder rests is variable.

11. A leg support, comprising:

framing means for securing upper ends of a pair of crutches so that the crutches form an A-frame structure; and a sling suspended from the framing means and configured to serve as a leg support.

12. The leg support of claim 11, wherein said framing means comprises a flared bag of flexible material having a closed end which is narrower than an opposite open end.

13. The leg support of claim 11, wherein said sling is sufficiently flexible to conform to a user's leg.

14. The leg support of claim 13, wherein said sling comprises cloth-like material.

15. The leg support of claim 11, further comprising a plurality of straps attached to the framing means and adapted to suspend the sling from the framing means.

16. The leg support of claim 15, wherein said straps are independently adjustable so that the suspension distance of the sling from the framing means is variable.

17. Apparatus for supporting a person's leg from a pair of crutches, each crutch having a horizontal support member at its upper end and terminating at a distal end, said apparatus comprising:

a sling support adapted to hold horizontal support members of a pair of crutches tightly together such that the distal ends of the crutches may be spaced apart to form an A-frame structure; and a sling suspended from the sling support.

18. The leg support of claim 17, wherein said sling support comprises a bag of flexible material having a closed end and a flared opposite open end.

* * * * *